US011110709B2

(12) United States Patent
Levy et al.

(10) Patent No.: US 11,110,709 B2
(45) Date of Patent: Sep. 7, 2021

(54) SYSTEM AND METHOD FOR CLEANING A PRINTHEAD

(71) Applicant: XEROX CORPORATION, Norwalk, CT (US)

(72) Inventors: Michael J. Levy, Webster, NY (US); Seemit Praharaj, Webster, NY (US); Jason M. LeFevre, Penfield, NY (US); Linn C. Hoover, Webster, NY (US); Paul J. McConville, Webster, NY (US); Chu-heng Liu, Penfield, NY (US); Douglas K. Herrmann, Webster, NY (US); David A. Vankouwenberg, Avon, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/780,419

(22) Filed: Feb. 3, 2020

(65) Prior Publication Data

US 2021/0060955 A1 Mar. 4, 2021

Related U.S. Application Data

(60) Provisional application No. 62/894,185, filed on Aug. 30, 2019.

(51) Int. Cl.
*B41J 2/165* (2006.01)

(52) U.S. Cl.
CPC ..... *B41J 2/16552* (2013.01); *B41J 2/16538* (2013.01); *B41J 2002/16558* (2013.01)

(58) Field of Classification Search
CPC ..... B41J 2002/1655
See application file for complete search history.

(56) References Cited

U.S. PATENT DOCUMENTS

| | | | | |
|---|---|---|---|---|
| 9,162,465 | B1 | 10/2015 | Tamarez Gomez et al. | |
| 9,862,194 | B2 * | 1/2018 | Gaston Llado | B41J 2/16538 |
| 2014/0085376 | A1 * | 3/2014 | Kato | B41J 2/16552 347/33 |
| 2016/0263897 | A1 * | 9/2016 | Kobashi | B41J 2/16538 |
| 2018/0345671 | A1 * | 12/2018 | Yoshii | B41J 2/16552 |
| 2020/0247126 | A1 * | 8/2020 | Kikuchi | B41J 2/16552 |

OTHER PUBLICATIONS

U.S. Appl. No. 16/561,592, filed Sep. 5, 2019.

* cited by examiner

*Primary Examiner* — Shelby L Fidler
(74) *Attorney, Agent, or Firm* — Pillsbury Winthrop Shaw Pittman LLP

(57) ABSTRACT

A system for cleaning and treating a printhead includes (a) a movable carriage having affixed to a base of the movable carriage a cleaning blade and an absorptive pad, (b) a low vapor pressure organic solvent, the low vapor pressure organic solvent is deliverable to the absorptive pad via a pump, the low vapor pressure organic solvent has a vapor pressure lower than water and (c) a carriage moving mechanism that moves the carriage so that the cleaning blade and the absorptive pad pass over the printhead.

13 Claims, 3 Drawing Sheets

SYSTEM AND METHOD FOR CLEANING A PRINTHEAD

CROSS REFERENCE TO RELATED APPLICATIONS

This application is a non-provisional application claiming priority to of U.S. Provisional Application Ser. No. 62/894,185, filed Aug. 30, 2019 which is incorporated herein by reference in its entirety

BACKGROUND

The present disclosure relates to printhead maintenance in inkjet printing. In particular, the present disclosure relates to systems and methods for cleaning printheads.

Poor jetting, or "ratty" printing, is caused by small bits of ink that break off the main ink drop, referred to as "satellites," that are ejected from the printhead and land on the printhead face. These small bits of ink dry on face of the printhead near in the vicinity of where ink is ejected and build up over time. When enough of these small drops land on the printhead face, they can partially block the jetting orifice and redirect the main drop causing poor jetting.

Embodiments disclosed herein provide printhead cleaning and treatment systems and methods that address the build-up of ink on the printhead to improve print quality. The system and methods are particularly valuable in high volume print run jobs. These and other advantages will be apparent to those skilled in the art.

SUMMARY

In some aspects, embodiments herein relate to systems for cleaning a printhead comprising a (a) movable carriage having affixed to a base of the movable carriage a cleaning blade and an absorptive pad, (b) a low vapor pressure organic solvent, wherein the low vapor pressure organic solvent is deliverable to the absorptive pad via a pump, and wherein the low vapor pressure organic solvent has a vapor pressure lower than water; and (c) a carriage moving mechanism that moves the carriage so that the cleaning blade and the absorptive pad pass over the printhead.

In some aspects, embodiments herein relate to methods of cleaning a printhead comprising providing a system for cleaning a printhead comprising a movable carriage having affixed to a recessed base a cleaning blade, and an absorptive pad; and a low vapor pressure organic solvent, wherein the low vapor pressure solvent is deliverable to the absorptive pad via a pump, and wherein the low vapor pressure organic solvent has a vapor pressure lower than water, and moving the carriage so that the cleaning blade and the absorptive pad pass over the printhead.

In some aspects, embodiments herein relate to carriages for cleaning a printhead comprising a base, the base comprising a cleaning blade; and an absorptive pad having a replenishable supply of a low vapor pressure organic solvent.

BRIEF DESCRIPTION OF DRAWINGS

Various embodiments of the present disclosure will be described herein below with reference to the figures wherein.

DETAILED DESCRIPTION

Figure 1:
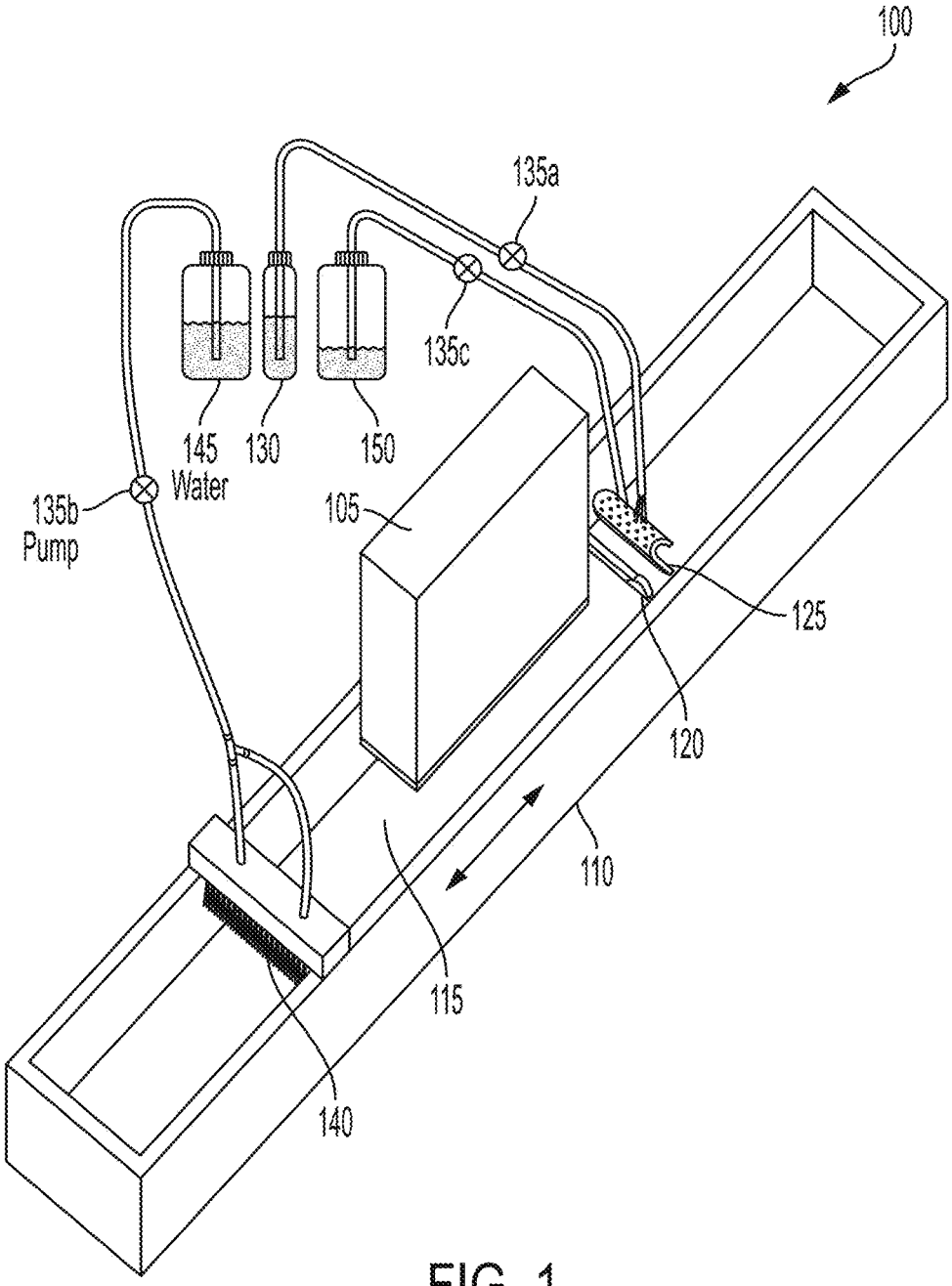
FIG. 1 shows an exemplary printhead cleaning system in accordance with embodiments herein.

Inkjet printing machines or printers include at least one printhead that ejects drops or jets of liquid ink onto recording media or onto an image receiving member surface. The media used in both direct and offset printers are typically provided in sheet or web form. A media sheet printer typically includes a supply drawer that houses a stack of media sheets. A feeder removes a sheet of media from the supply and directs the sheet along a feed path past a printhead so the printhead ejects ink directly onto the sheet. In a web printer, a continuous supply of media, typically provided in a media roll, is entrained onto rollers that are driven by motors. The motors and rollers pull the web from the supply roll through the printer to a take-up roll. As the media web passes through a print zone opposite the printhead or heads of the printer, the printheads eject ink onto the web. Along the feed path, tension bars or other rollers remove slack from the web so the web remains taut without breaking.

Printers can conduct various maintenance operations to ensure that the ink ejectors in each printhead operate efficiently. A cleaning operation is one such maintenance operation. The cleaning process removes particles or other contaminants that interfere with printing operations from the printhead, and unclogs solidified ink or contaminants from inkjet ejectors.

Embodiments herein provide systems and methods to fix poor jetting by cleaning and treating the printheads with a low vapor pressure organic solvent to prevent the accumulation of dried ink (small bits of ink called "satellites") near the jetting orifice. Modifications to the printing system include altering the cleaning blade and printhead face seal cleaning system and connectivity to a source of a low vapor pressure solvent. The modifications can be used in connection with printing systems like, for example without limitation, those described in U.S. Pat. No. 9,162,465 and U.S. patent application Ser. No. 16/561,592, filed on Sep. 5, 2019, both of which are incorporated herein by reference in their entireties. In embodiments, the modifications described herein can be used in place of or in combination with the purge system and capping station or plurality of caps used to clean the printheads as disclosed in U.S. Pat. No. 9,162,465 and U.S. patent application Ser. No. 16/561,592. The embodiments may be modified to be used in both professional or large format printers and personal printers, and the relevant components such as the absorptive pad and the cleaning blade can be scaled up or down accordingly.

Applying a thin layer of low vapor pressure organic solvent on an absorptive material to the printhead face, in accordance with embodiments herein, has been shown to greatly improve the quality of printing in high stress (100% ink coverage) areas. This cleaning and treatment action with low vapor pressure organic solvent on the printheads can be easily integrated into existing hardware. The addition of a low vapor pressure organic solvents to the system also solves another problem in which dried ink in the ink waste tray contaminates the print head face. In the present embodiments, the low vapor pressure organic solvent serves to re-solubilize the dried ink in the waste tray further improving print quality.

In embodiments, there are provided systems for cleaning a printhead comprising (1) a movable carriage having affixed to its base a cleaning blade and an absorptive pad; (2) a low vapor pressure organic solvent, wherein the low vapor pressure solvent is deliverable to the absorptive pad via a pump, wherein the low vapor pressure organic solvent has a vapor pressure lower than water; and (3) a carriage moving mechanism that moves the carriage so that the cleaning blade and the absorptive pad pass over the printhead.

Referring now to FIG. 1, there is shown an exemplary system 100 for cleaning a printhead 105. System 100 includes a movable carriage 110, which serves as a waste tray for spent solvents employed in system 100. Carriage 110 is shown as a recessed rectangular box (though it may take other shapes) having affixed to its base 115 a cleaning blade 120 and an absorptive pad 125. Movable carriage 110 is designed so that cleaning blade 120 and absorptive pad 125 move across the entire printing surface of printhead 105. Excess inks, solvents, dirt and the like collect at the bottom of movable carriage 110 when in use and are readily removed.

System 100 feeds absorptive pad 125 with a low vapor pressure organic solvent 130 via pump 135*a*. This solvent provides solubilization of the satellite ink and assists in removal to waste. In embodiments, low vapor pressure organic solvent 130 has a vapor pressure less than about 1 kpascal at 25° C. Examples of such solvents include, without limitation, an organic solvent selected from the group consisting of amyl acetate, benzyl alcohol, n-butanol, cyclohexane, ethyl glycol, ethylene glycol, tetrachloroethane, and nonane. Functionally, any solvent may be used to carry out the cleaning of printhead 105 so long as it is compatible with printhead 105, e.g., compatible with adhesives in the printhead and desirably has a low vapor pressure which reduces environmental impact due to volatile organic compounds and facilitates collection and removal of waste ink. One fluid line that is commercially available that may be used to clean printheads is Kayajet cleaners such as CL66 or CL67 (Nippon Kayaku, JP).

In embodiments, systems may further comprise a brush that is fixed stationary relative to the carriage, wherein the carriage moving mechanism passes the cleaning blade and absorptive pad past the brush, thereby allowing the brush to clean the cleaning blade and the absorptive pad. Referring again to FIG. 1, a brush 140 is held stationary relative to carriage 110. In use, carriage 110 slides past brush 140 allowing cleaning blade 120 and absorptive pad 125 to be scrubbed by brush 140. In embodiments, systems may further comprise a water source and a pump to deliver water to the brush. As indicated in FIG. 1, brush 140 is fed water 145 via pump 135*b*. In embodiments, a low vapor pressure organic solvent may also be used in lieu of water.

In embodiments, systems may further comprise a waste collection system to remove spent water and organic solvent from the carriage. In embodiments, the waste collection system comprises a pump, tubing connected to the pump and disposed near the bottom of the carriage, and a waste container. As indicated in FIG. 1, pump 135*c* equipped with tubing may be used to evacuate carriage 110 out to waste 150. The tubing from pump 135*c* may be disposed through the top of carriage 110 or may be through a hole in base 115 of carriage 110. In embodiments, the waste collection system comprises a non-porous structure for base 115 of carriage 110.

In embodiments, there are provided methods of cleaning a printhead comprising providing a system for cleaning a printhead comprising a movable carriage having affixed to a recessed base a cleaning blade and an absorptive pad, and a low vapor pressure organic solvent, wherein the low vapor pressure solvent is deliverable to the absorptive pad via a pump, and wherein the low vapor pressure organic solvent has a vapor pressure lower than water, the method further comprising moving the carriage so that the cleaning blade and the absorptive pad pass over the printhead.

In embodiments, methods may further comprise removing waste from the bottom of the carriage. In embodiments, methods may further comprise moving the carriage so that the cleaning blade and the absorptive pad pass over a brush that cleans the cleaning blade and the absorptive pad. In embodiments, methods may further comprise delivering water to the brush.

In embodiments, the carriage is moved so that the cleaning blade and the absorptive pad pass over the printhead after each ink purge. In embodiments, the cleaning blade is configured to remove bulk material first and the absorptive pad follows the cleaning blade. Such an arrangement helps avoid oversaturating the absorptive pad with the bulk of the waste materials being removed and can increase the lifespan and effectiveness of the absorptive pad.

In embodiments, there are provided carriages for cleaning a printhead comprising a base, the base comprising a cleaning blade and an absorptive pad having a replenishable supply of a low vapor pressure organic solvent. In embodiments, the carriage is recessed allowing collection of waste. In embodiments, the base is non-porous and made of aluminum.

The cleaning systems and methods disclosed herein are readily implemented in commercial printing systems, such as the BALTORO™ HF Inkjet Press, available from Xerox Corporation, and as generally described, at least in part, in U.S. Pat. No. 9,162,465 and U.S. patent application Ser. No. 16/561,592, filed on Sep. 5, 2019, both of which are incorporated herein by reference in their entireties.

EXAMPLES

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

Example 1

This example describes the use of a low vapor pressure organic solvent to improve print quality.

Figure 2:
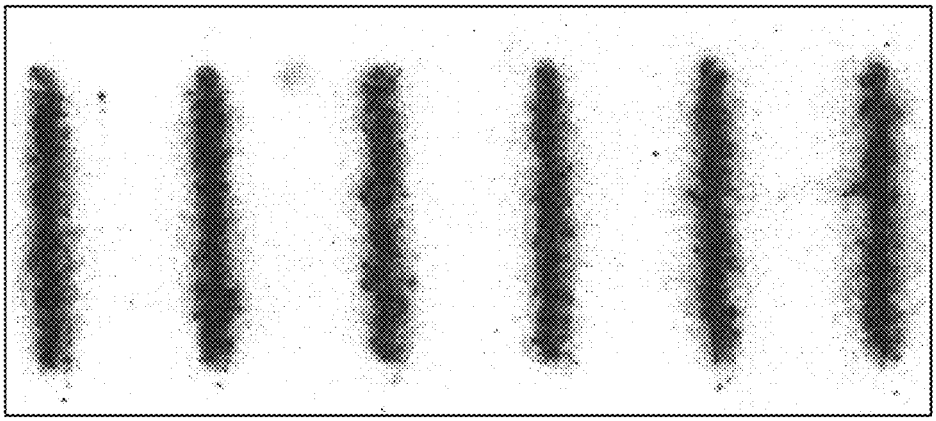
FIG. 2 shows a print image of an area of one-pixel width lines in a low stress print area from a 2,500 volume print run.
Figure 3:
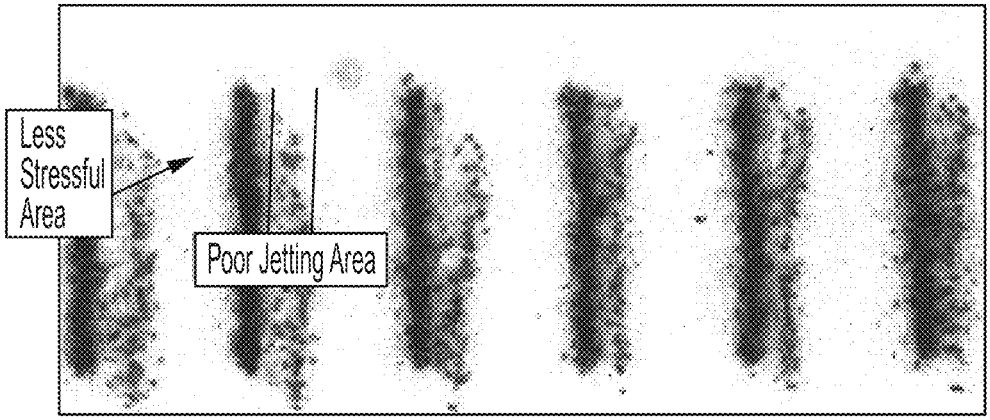
FIG. 3 shows a print image indicating "ratty" printing in an area of one-pixel width lines in an area of high ink coverage from a 2,500 volume print run.

A 2,500-print test was run on a printer with an image that showed poor jetting concentrated in the high ink areas. A control sheet showing each jet of the printhead was sent at the start and end of the 2,500-sheet run. This was a control test to see if poor jetting could be observed, and it was observed. Print quality of the jets in a less stressful area of the print was measured. The quality of one-pixel width lines in the less stressful area was measured with a Pias (CCD camera used for taking photomicrographs) under high magnification and is shown in FIG. 2. In FIG. 2, jetting is shown after 2,500 prints with the center black print-head in areas that were less stressful. An example of poor ("ratty") jetting seen in areas of high ink coverage was indicated as shown in FIG. 3. FIG. 3 shows jetting after 2,500 prints with the center black print-head in areas that did had a solid black stripe in the target.

Figure 4:
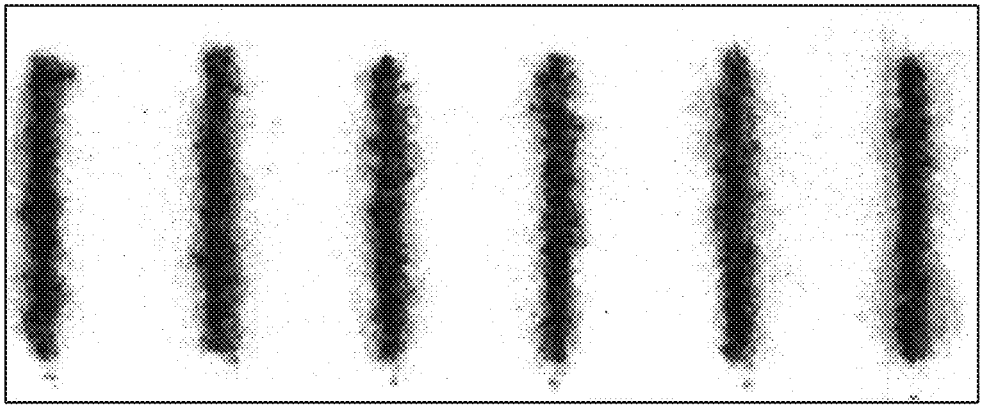
FIG. 4 shows a print image of the same area of one-pixel width lines in the high ink coverage area after cleaning and treating the printhead with a low vapor pressure organic solvent.

Then another 2,500-sheet test was conducted after the print heads were cleaned by a purge, then wiped with a high vapor pressure solvent compatible with the printheads. This print run also had a control sheet at the start and end of the run. The printhead jets looked much better after this 2,500-print run, as indicated in FIG. 4. FIG. 4 is from the same black stripe area as FIG. 3. Without being bound by theory, it is postulated that thin film of solvent, which has a very slow evaporation rate, allows the small drops that land on the head surface to re-solubilize and join the fluid ink back into the nozzle.

Example 2

This example describes how to implement the result obtained in the proof of principle experiment of Example 1.

To implement this improved jetting quality result one can add a jug of a low vapor pressure organic solvent (subject to compatibility with the printhead) next to the water and waste ink container with its own peristaltic pump. Two fluid lines containing water would still go to the blue cleaner brush and a third line from the low vapor pressure organic solvent jug can be directed to a foam applicator pad located behind the cleaning blade and slightly higher so it can coat the print head face with the low vapor pressure solvent during the normal cleaning cycle (see FIG. 1). The normal cleaning operation could be run, pumping water to the brush can be carried out for a reduced time of about 4 seconds, then for the last second pump the low vapor organic solvent into the applicator pad. The applicator pad will still function when it is "dirty" because the low vapor pressure organic solvent solubilizes any ink present. The cleaning apparatus will move the cleaning blade and saturated foam past the print head face and continue moving until it stops under the cleaning brush.

Although embodiments disclosed herein have been discussed with reference to specific embodiments, it is understood that various modifications may be made without departing from the spirit and scope of the disclosure and consistent with the following claims.

What is claimed is:

1. A system for cleaning a printhead comprising:

(a) a movable carriage having affixed to a base:
  a cleaning blade; and
  an absorptive pad;

(b) a low vapor pressure organic solvent;
  wherein the low vapor pressure organic solvent is deliverable to the absorptive pad via a pump; and
  wherein the low vapor pressure organic solvent has a vapor pressure lower than water;

and (d) a brush that is fixed so that the brush is stationary relative to the carriage, wherein movable carriage is configured to move the cleaning blade and absorptive pad past the brush, thereby allowing the brush to clean the cleaning blade and the absorptive pad.

2. The system of claim 1, wherein the low vapor pressure organic solvent has a vapor pressure less than about 1 kpascal at 25° C.

3. The system of claim 1, wherein the low vapor pressure organic solvent is selected from the group amyl acetate, benzyl alcohol, n-butanol, cyclohexane, ethyl glycol, ethylene glycol, tetrachloroethane, and nonane.

4. The system of claim 1, further comprising a water source and a pump to deliver water to the brush.

5. The system of claim 1, further comprising a waste collection system to remove spent water, purged ink and organic solvent from the carriage.

6. The system of claim 5, wherein the waste collection system comprises a pump, tubing connected to the pump and disposed near the bottom of the carriage, and a waste container.

7. The system of claim 5, where the waste collection system comprises a non-porous structure at the bottom of the carriage.

8. A method of cleaning a printhead comprising:

providing a system for cleaning a printhead comprising:

a. a movable carriage having affixed to a recessed base:
  a cleaning blade; and
  an absorptive pad; and b. a low vapor pressure organic solvent;
  wherein the low vapor pressure solvent is deliverable to the absorptive pad via a pump; and
  wherein the low vapor pressure organic solvent has a vapor pressure lower than water; and moving the carriage so that the cleaning blade and the absorptive pad pass over the printhead; and moving the carriage so that the cleaning blade and the absorptive pad pass over a brush that cleans the cleaning blade and the absorptive pad.

9. The method of claim 8, further comprising removing waste from the bottom of the carriage.

10. The method of claim 8, further comprising delivering water to the brush.

11. The method of claim 8, wherein the carriage is moved so that the cleaning blade and the absorptive pad pass over the printhead after an ink purge.

12. The method of claim 8, wherein the low vapor pressure organic solvent has a vapor pressure less than about 1 kpascal at 25° C.

13. The method of claim 8, wherein the low vapor pressure organic solvent is selected from the group amyl acetate, benzyl alcohol, n-butanol, cyclohexane, ethyl glycol, ethylene glycol, tetrachloroethane, and nonane.

* * * * *